US008099808B1

(12) United States Patent
McKeon

(10) Patent No.: US 8,099,808 B1
(45) Date of Patent: Jan. 24, 2012

(54) STABILIZING A PATIENT'S KNEE

(75) Inventor: Brian P. McKeon, Essex, MA (US)

(73) Assignee: Perseus Athletics, LLC, Essex, MA (US)

( * ) Notice: Subject to any disclaimer, the term of this patent is extended or adjusted under 35 U.S.C. 154(b) by 21 days.

(21) Appl. No.: 12/715,013

(22) Filed: Mar. 1, 2010

Related U.S. Application Data

(60) Provisional application No. 61/156,451, filed on Feb. 27, 2009.

(51) Int. Cl.
*A61G 13/12* (2006.01)

(52) U.S. Cl. ..... 5/624; 5/621; 5/650

(58) Field of Classification Search ..... 5/624, 648, 5/621–623, 649–651, 646, 647, 503.1, 658, 5/663
See application file for complete search history.

(56) References Cited

U.S. PATENT DOCUMENTS

| | | | | | |
|---|---|---|---|---|---|
| 2,535,559 | A | * | 12/1950 | Wolf | 5/630 |
| 2,801,142 | A | * | 7/1957 | Adams | 5/646 |
| 3,817,512 | A | * | 6/1974 | Torrey | 5/632 |
| 4,181,297 | A | * | 1/1980 | Nichols | 5/650 |
| 4,526,355 | A | * | 7/1985 | Moore et al. | 5/624 |
| 4,717,133 | A | * | 1/1988 | Walsh et al. | 5/650 |
| 6,012,456 | A | * | 1/2000 | Schuerch | 128/869 |

* cited by examiner

*Primary Examiner* — Robert G Santos
(74) *Attorney, Agent, or Firm* — Fish & Richardson P.C.

(57) ABSTRACT

A leg holder assembly includes a leg support apparatus and a rail attachment mechanism. The leg support apparatus includes a planar support apparatus and a plurality of adjustable arms. The adjustable arms are pivotable. A patient's leg can be received within a space defined between the adjustable arms and rested on the planar support apparatus. The leg support apparatus also includes a support shaft. The rail attachment mechanism includes a body and a plurality of attachment arms. The rail attachment mechanism can be secured to the rail of an operating table by hooking the arms of the rail attachment mechanism over the rail of the operating table. A slot formed within the body of the rail attachment mechanism receives the support shaft and enables the support shaft to be slid into and out of the slot for attachment and detachment of the leg support apparatus to the operating table.

11 Claims, 3 Drawing Sheets

STABILIZING A PATIENT'S KNEE

CROSS REFERENCE TO RELATED APPLICATION

The present application claims priority from U.S. Provisional Patent Application Ser. No. 61/156,451, filed on Feb. 27, 2009 and entitled "Stabilizing a Patient's Knee," the disclosure of which is incorporated herein by reference in its entirety.

TECHNICAL FIELD

This disclosure relates to stabilizing a patient's knee.

BACKGROUND

During knee surgery, a leg holder may be used to stabilize a patient's knee while a surgeon operates on the patient's knee.

SUMMARY

A leg holder assembly includes a leg support apparatus and a rail attachment mechanism. The leg support apparatus includes a planar support apparatus and a plurality of adjustable arms. The adjustable arms are pivotable. A patient's leg can be received within a space defined between the adjustable arms and rested on the planar support apparatus. The leg support apparatus also includes a support shaft. The rail attachment mechanism includes a body and a plurality of attachment arms. The rail attachment mechanism can be secured to the rail of an operating table by hooking the arms of the rail attachment mechanism over the rail of the operating table. A slot formed within the body of the rail attachment mechanism receives the support shaft and enables the support shaft to be slid into and out of the slot for attachment and detachment of the leg support apparatus to the operating table.

The details of one or more implementations are set forth in the accompanying drawings and the description below. Other features will be apparent from the description and drawings, and from the claims.

DETAILED DESCRIPTION

A leg holder for stabilizing a patient's leg during knee surgery includes adjustable, self-locking prongs that are configured to support the patient's leg in a desired position and to enable a surgeon or other healthcare professional to clamp the prongs around the patient's leg as tightly as desired. The prongs also may be configured to accommodate a tourniquet (e.g., a thigh tourniquet) to be applied to the patient's leg. In order to allow the surgeon or other healthcare professional to orient a patient's leg in a position that is desirable for the surgery being performed (e.g., a position of hyperflexion for anterior cruciate ligament (ACL) reconstructive surgery), the leg holder may be configured to articulate in several planes. The leg holder also may include a slip-on attachment configured to attach the leg holder to the rail of an operating table.

Additionally, various dimensions of the leg holder may be adjustable (e.g., via the use of spring-loaded pull-pins disposed around the leg holder) to allow for simple and instantaneous adjustments to the leg holder to accommodate varying leg sizes. Part or all of the leg holder may be formed from aluminum or an aluminum alloy, making the leg holder lightweight and easy to manipulate and clean. Furthermore, the leg holder may be collapsible into a compact form for convenient storage when not in use.

In some instances, the configuration of the leg holder may enable the leg holder to be secured to the operating table before the patient even lies down on the operating table. Then, when the patient lies down on the operating table, the patient's leg may be placed within the leg holder and the leg holder can be adjusted to the preferred position for surgery. In many cases, the leg holder enables the positioning of the patient's leg within the leg holder and the subsequent adjustments to the leg holder to position the patient's leg appropriately for surgery to be performed by a single healthcare professional. Furthermore, after surgery is complete, the configuration of the leg holder may enable the patient's leg to be removed from the leg holder and the patient to be removed from the bed while the leg holder remains secured to the operating table.

Figure 1:
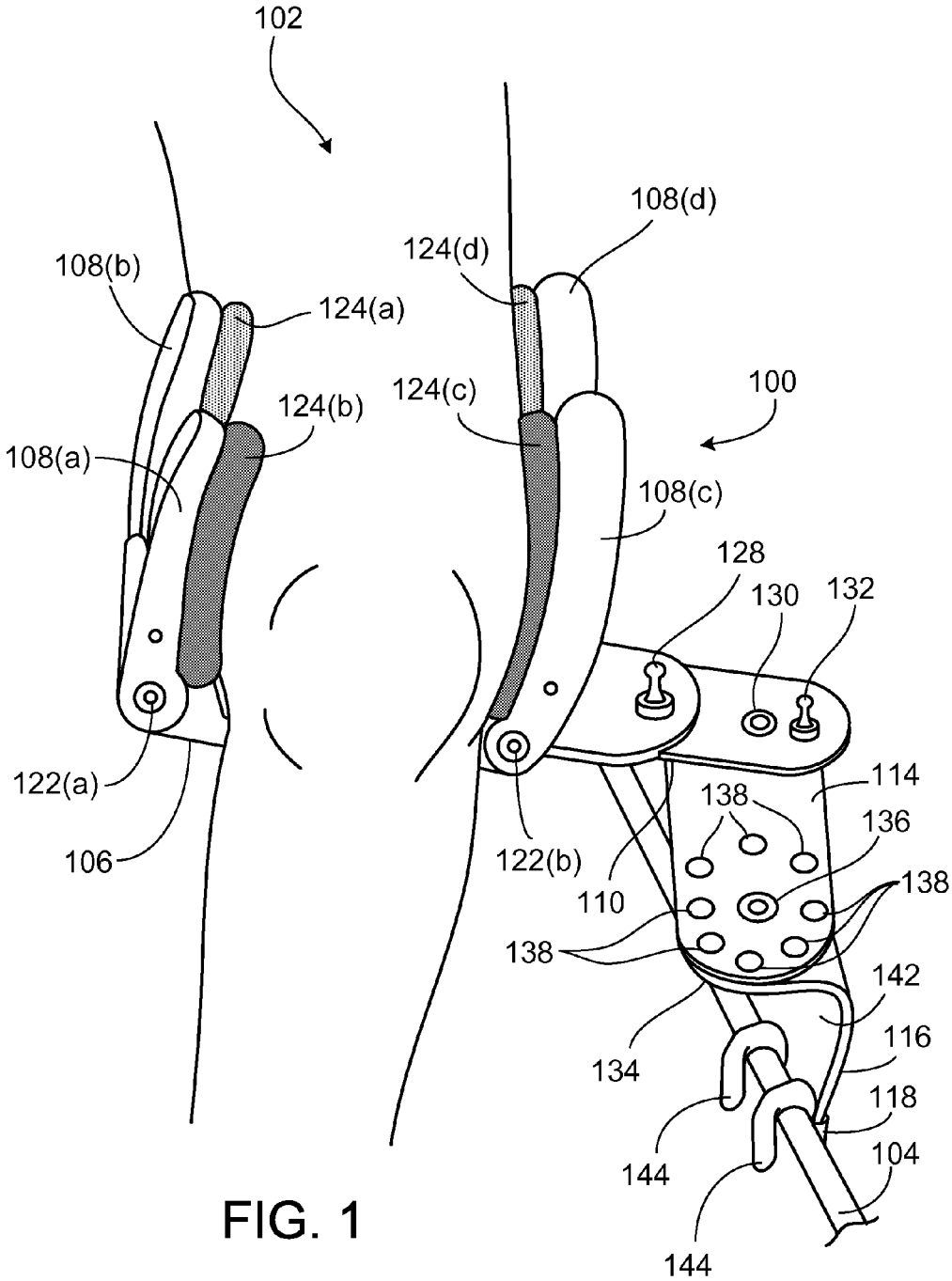
FIGS. 1 and 2 are views of an example of a leg holder for stabilizing a patient's leg during knee surgery.
Figure 2:
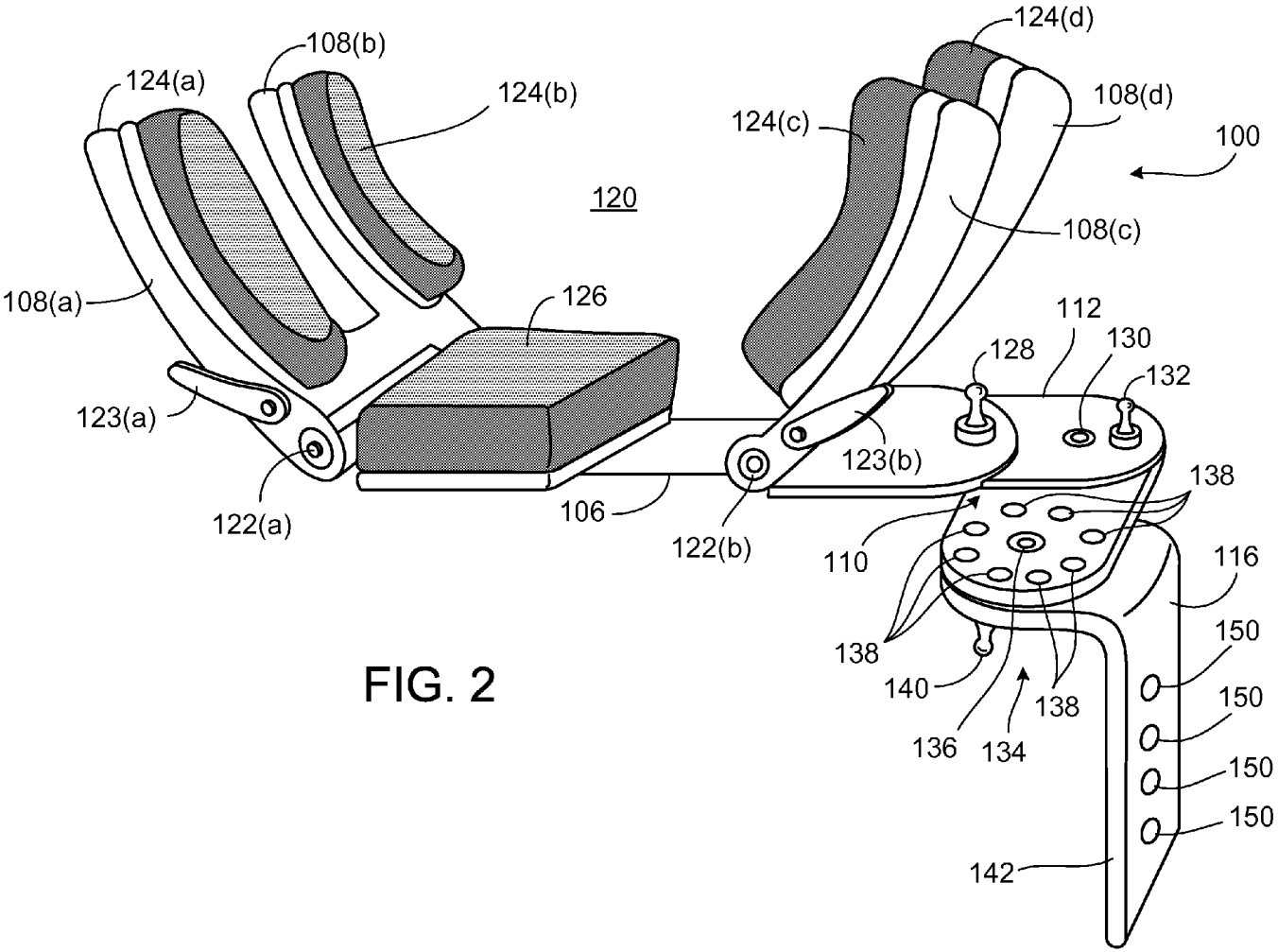

FIG. 1 is a view of a leg holder 100 that is stabilizing a patient's leg 102 and that is attached to a rail 104 of an operating table (not shown). FIG. 2 is a view of the leg holder 100 in isolation. As illustrated in FIGS. 1 and 2, the leg holder includes a lateral base plate 106 for supporting a patient's leg and from which four adjustable arms 108(*a*), 108(*b*), 108(*c*), and 108(*d*) extend in a generally upward direction. A groove 110 defined on the underside of the base plate 106 is configured to receive a base plate extension plate 112 such that the base plate extension plate 112 is slidable into and out of the groove 110, thereby enabling the lateral extent of the leg holder 100 to be adjusted (i.e., shortened or lengthened) to accommodate both various different leg sizes as well as leg positioning preferences of various different surgeons or other healthcare professionals. The base plate extension plate 112 itself is mounted on rotatable swivel plate 114. The swivel plate 114 enables rotation of the leg holder 100 in the general plane of the base plate 106. In addition, the swivel plate 114 enables the leg holder 100 to be reconfigured from a configuration intended to support a patient's left leg (e.g., as illustrated in FIGS. 1 and 2) to a configuration intended to support a patient's right leg. The swivel plate 114 itself is mounted on an L-shaped vertical support 116 that is configured to enable the leg holder 100 to be attached to the operating table (e.g., by way of a slip-on attachment mechanism 118 described more fully below in connection with FIG. 3) and to bear the weight of the patient's leg 102.

The four adjustable arms 108(*a*), 108(*b*), 108(*c*), and 108(*d*) that extend generally upward from the base plate 106 are configured to clamp onto the patient's leg 102, thereby securing the patient's leg 102 within the leg holder 100 and stabilizing the patient's leg 102 for surgery. As illustrated in FIGS. 1 and 2, the adjustable arms 108(*a*), 108(*b*), 108(*c*), and 108(*d*) are disposed along the base plate 106 in sets of two such that two arms 108(*a*) and 108(*b*) are positioned at a first lateral position along the base plate 106 and two arms 108(*c*) and 108(*d*) are positioned at a second lateral position along the base plate 106. The first and second lateral positions along the base plate 106 are displaced from one another such that a space 120 is defined between the first set of arms 108(*a*) and 108(*b*) and the second set of arms 108(*c*) and 108(*d*) that is intended to accommodate a patient's upper leg 102. The patient's upper leg 102 can be inserted into and received within this space 120 between the first set of adjustable arms 108(*a*) and 108(*b*) and the second set of adjustable arms 108(*c*) and 108(*d*).

The first set of adjustable arms 108(*a*) and 108(*b*) are attached to the base plate 106 by way of a first pivotable hinge 122(*a*) and the second set of adjustable arms 108(*c*) and 108(*d*) are attached to the base plate 106 by a second pivotable hinge 122(*b*). The first pivotable hinge 122(*a*) allows the first set of adjustable arms 108(*a*) and 108(*b*) to be rotated through a wide range of angles, for example, from a nearly horizontal, or even beyond horizontal, orientation to a vertical or even beyond vertical orientation. Likewise, the second pivotable hinge 122(*b*) allows the second set of adjustable arms 108(*c*) and 108(*d*) to be rotated through a wide range of angles, for example, from a nearly horizontal, or even beyond horizontal, orientation to a vertical or even beyond vertical orientation.

In this manner, the first set of adjustable arms 108(*a*) and 108(*b*) and the second set of adjustable arms 108(*c*) and 108(*d*) can be opened up to allow the patient's leg 102 to be easily inserted within the space 120 between the first set of arms 108(*a*) and 108(*b*) and the second set of arms 108(*c*) and 108(*d*). Thereafter, once the patient's leg 102 has been placed in the desired position between the first set of adjustable arms 108(*a*) and 108(*b*) and the second set of adjustable arms 108(*c*) and 108(*d*), the first set of adjustable arms 108(*a*) and 108(*b*) and the second set of adjustable arms 108(*c*) and 108(*d*) can be closed around the patient's leg as tightly as desired to secure the patient's leg 102 in the desired position and to stabilize the patient's leg 102 for surgery.

One or both of pivotable hinges 122(*a*) and 122(*b*) may be self-locking hinges that lock securely in position once the first set of adjustable arms 108(*a*) and 108(*b*) and the second set of adjustable arms 108(*c*) and 108(*d*), respectively, have been clamped around the patient's leg 102. For example, one or both of pivotable hinges 122(*a*) and 122(*b*) may include a ratchet mechanism that enables the first set of adjustable arms 108(*a*) and 108(*b*) and the second set of adjustable arms 108(*c*) and 108(*d*), respectively, to be tightened around the patient's leg 102 and that prevents the first set of adjustable arms 108(*a*) and 108(*b*) and the second set of adjustable arms 108(*c*) and 108(*d*), respectively, from being released from the patient's leg 102. Levers 123(*a*) and 123(*b*) are provided for the first set of adjustable arms 108(*a*) and 108(*b*) and the second set of adjustable arms 108(*c*) and 108(*d*), respectively, in order to disengage the ratchet mechanisms in the pivotable hinges 122(*a*) and 122(*b*) to enable the first set of adjustable arms 108(*a*) and 108(*b*) and the second set of adjustable arms 108(*c*) and 108(*d*), respectively, to be collapsed so that the patient's leg 102 can be removed from or repositioned within the leg holder 100.

More particularly, in one specific example, one or both of pivotable hinges 122(*a*) and 122(*b*) includes a cylindrical groove bar (e.g., a cylindrically shaped bar having a number of uniform but asymmetrically shaped teeth having opposing steep and shallow slopes) and a pivoting pawl (e.g., a spring-loaded finger). The pivoting pawl engages the teeth formed on the cylindrical groove bar in a manner that enables the pawl to slide over the shallow slopes of the teeth when the pivotable hinges 122(*a*) and 122(*b*) are pivoted so as to clamp the first set of adjustable arms 108(*a*) and 108(*b*) and the second set of adjustable arms 108(*c*) and 108(*d*) around the patient's leg 102, thereby enabling the first set of adjustable arms 108(*a*) and 108(*b*) and the second set of adjustable arms 108(*c*) and 108(*d*) to be closed around the patient's leg 102. However, when the pivotable hinges 122(*a*) and 122(*b*) are attempted to be pivoted in the opposite direction, the pawl catches the steep slope of the nearest tooth, preventing the pivotable hinges 122(*a*) and 122(*b*) from being rotated in this direction, thereby enabling the first set of adjustable arms 108(*a*) and 108(*b*) and the second set of adjustable arms 108(*c*) and 108(*d*) to be locked around the patient's leg 102 at the desired tightness.

In another specific example, a smooth, toothless ratchet mechanism with a high friction surface such as, for example, rubber may be used as an alternative to the cylindrical groove bar ratchet mechanism described above. In this example, the pawl bears against the surface of the bar at an angle that enables the pivotable hinges 122(*a*) and 122(*b*) to be rotated so as to close the first set of adjustable arms 108(*a*) and 108(*b*) and the second set of adjustable arms 108(*c*) and 108(*d*) around the patient's leg 102 but that causes the pawl to jam against the surface of the bar and thus prevent any motion in the opposite direction when the pivotable hinges 122(*a*) and 122(*b*) are attempted to be pivoted to open the first set of adjustable arms 108(*a*) and 108(*b*) and the second set of adjustable arms 108(*c*) and 108(*d*) from around the patient's leg 102. In some implementations, foam pads 124(*a*), 124(*b*), 124(*c*) and 124(*d*) (e.g., rubber foam pads) are disposed on the surfaces of the adjustable arms 108(*a*), 108(*b*), 108(*c*), and 108(*d*) that clamp down around the patient's leg 102. These foam pads 124(*a*), 124(*b*), 124(*c*) and 124(*d*) provide cushioning for the patient's leg 102, which may make the leg holder 100 more comfortable for the patient. In addition, the elastomeric characteristics of the foam pads 124(*a*), 124(*b*), 124(*c*) and 124(*d*) may enable the adjustable arms 108(*a*), 108(*b*), 108(*c*), and 108(*d*) of the leg holder 100 to stabilize the patient's leg 102 more securely.

Furthermore, the positioning of the adjustable arms 108(*a*), 108(*b*), 108(*c*), and 108(*d*), and the ability to collapse the adjustable arms 108(*a*), 108(*b*), 108(*c*), and 108(*d*) may enable a thigh tourniquet (not shown) to be draped through the arms 108(*a*), 108(*b*), 108(*c*), and 108(*d*) prior to the patient's leg 102 being placed into the leg holder 100. Then, after the patient's leg 102 has been placed into the leg holder 100, the thigh tourniquet can be secured around the patient's leg 102 as desired by a surgeon or other healthcare professional for surgery.

In addition, in some implementations, a loam pad 126 (e.g., a rubber foam pad) also is disposed on the base plate 106 between the first set of adjustable arms 108(*a*) and 108(*b*) and the second set of adjustable arms 108(*c*) and 108(*d*). The patient's leg 102 is intended to be rested on this foam pad 126 and the foam pad 126 is configured to provide cushioning for the underside of the patient's leg 102 while it is secured within the leg holder 100.

Foam pads 124(*a*), 124(*b*) 124(*c*), 124(*d*) and 126 may be disposable and removably attached to the leg holder 100 such that foam pads 124(*a*), 124(*b*) 124(*c*), 124(*d*) and 126 may be removed from the leg holder 100 and disposed of after each use.

As described above, a groove 110 is formed on the underside of the base plate 106 and is configured to receive base plate extension plate 112, thereby enabling the base plate 106 and the base plate extension plate 112 to be mechanically coupled. In addition, the groove 110 formed in the base plate 106 enables the base plate extension plate 112 to be slid into and out of the base plate 106, thereby enabling the lateral extent of the leg holder 100 to be adjusted. A number of locking holes (not shown) are formed through the base plate extension plate 112 along a lateral dimension of the base plate extension plate 112. These locking holes are configured to receive a spring-loaded pull pin 128 mounted on and threaded through the base plate 106, thereby enabling the lateral extent of the leg holder 100 to be locked into any of a number of different lengths by pulling the spring-loaded pull pin 128 out of and away from the base plate 106, sliding the base plate extension plate 112 into or out of the base plate 106 until the spring-loaded pull pin 128 is aligned with one of the locking holes formed in the base plate extension plate 112, and then releasing the spring-loaded pull pin 128 such that it engages the hole formed in the base plate extension plate 112.

In addition to being mechanically coupled to the base plate 106, the base plate extension plate 112 also is mounted on (or otherwise mechanically coupled to) the swivel plate 114. For example, as illustrated in FIGS. 1 and 2, the base plate extension plate 112 is mechanically coupled to the swivel plate 114 by a pivotable joint 130 that enables the swivel plate 114 to be rotated about the base plate extension plate 112. In addition, at least two locking holes (not shown) are formed through the swivel plate 114 on opposing sides of a distal end of the swivel plate 114 for locking the swivel plate 114 at a fixed angle relative to the base plate extension plate 112. These locking holes are configured to receive a spring-loaded pull pin 132 mounted on and threaded through the base plate extension plate 112 thereby enabling the swivel plate 114 to be locked into any of a number of different angles relative to the base plate extension plate 112 by pulling the spring-loaded pull pin 132 out of and away from the base plate extension plate 112, rotating the swivel plate 114 about the base plate extension plate 112 until the spring-loaded pull pin 132 is aligned with one of the locking holes formed in the swivel plate 114, and then releasing the spring-loaded pull pin 132 such that it engages the hole formed in the swivel plate 114. Among other things, the ability to rotate the swivel plate 114 relative to the base plate extension plate 112 in this manner enables the swivel plate 114 to be rotated from the position illustrated in FIGS. 1 and 2, in which the leg holder 100 is configured to stabilize a patient's left leg, 180° or so to an opposite position, in which the leg holder 100 is configured to stabilize a patient's right leg, thereby enabling the leg holder 100 to be used to stabilize a patient's leg during surgery irrespective of on which leg surgery is being performed.

The swivel plate 114 itself is mounted on (or otherwise mechanically coupled to) the L-shaped vertical support 116 that enables the leg holder 100 to be attached to the operating table and that bears the weight of the patient's leg 102. For example, as illustrated in FIGS. 1 and 2, the swivel plate 114 is mechanically coupled to a base plate portion 134 of the L-shaped support by a pivotable joint 136 that enables the swivel plate 114 to be rotated about the L-shaped support 116. In addition, a number of locking holes 138 are formed through the swivel plate 114 in a substantially circular pattern at a proximal end of the swivel plate 114 for locking the swivel plate 114 at a fixed angle relative to L-shaped support 116. These locking holes 138 are configured to receive a spring-loaded pull pin 140 mounted on and threaded through the base portion 134 of the L-shaped support 116 thereby enabling the swivel plate 114 to be locked into any of a number of different angles relative to the L-shaped support 116 by pulling the spring-loaded pull pin 138 out of and away from the base portion 134 of the L-shaped support 116, rotating the swivel plate 114 about the base portion 134 of the L-shaped support 116 until the spring-loaded pull pin 140 is aligned with one of the locking holes 138 formed in the swivel plate 114, and then releasing the spring-loaded pull pin 140 such that it engages the locking hole 138 formed in the swivel plate 114. Among other things, the ability to rotate the swivel plate 114 relative to the L-shaped support 116 in this manner enables the angle of the leg holder 100, and thus the angle of the patient's leg 102, to be adjusted to the angle desired by the surgeon or other healthcare professional.

Figure 3:
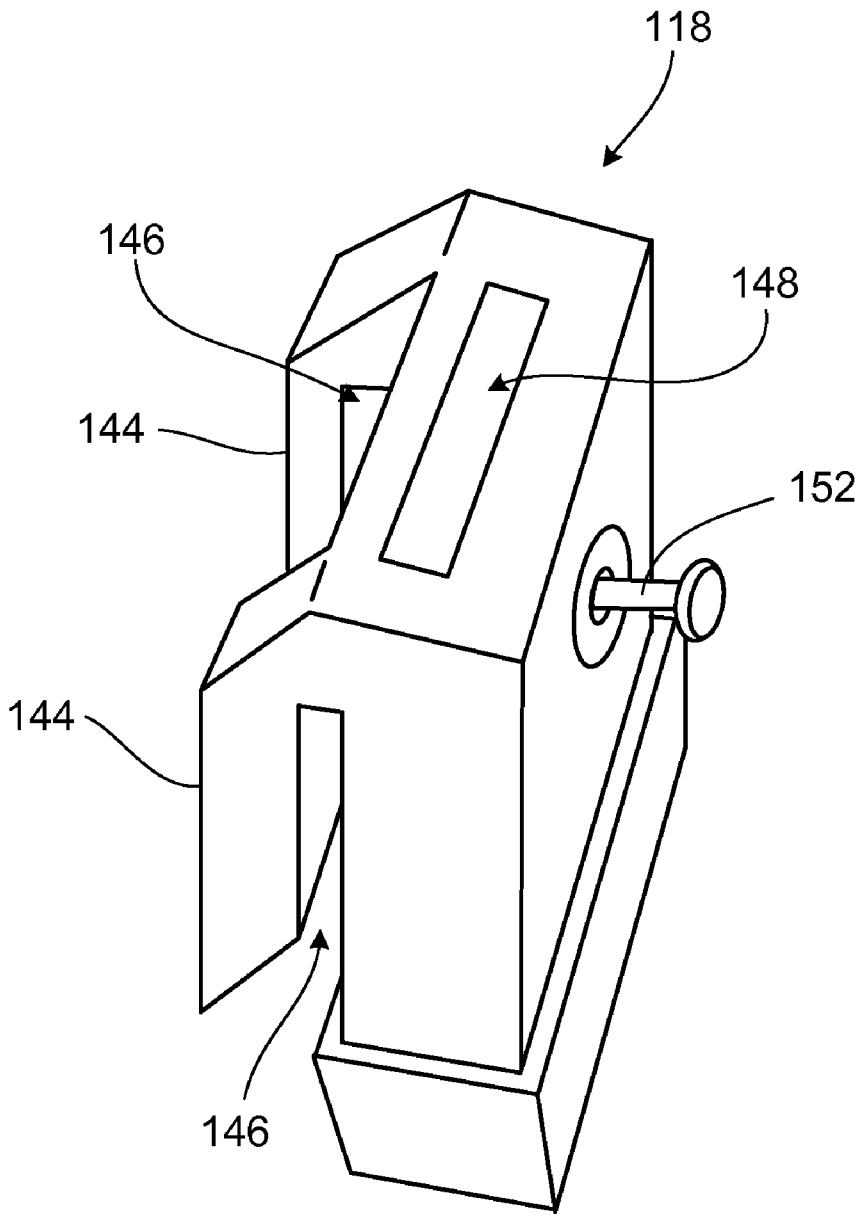
FIG. 3 is a view of an attachment mechanism for attaching a leg holder to an operating table.

A shaft portion 142 of the L-shaped support 116 extends generally downward from the base portion 134 of the L-shaped support 116 substantially perpendicularly to the base portion 134 of the L-shaped support 116. The shaft portion 142 of the L-shaped support 116 is configured to be received within an attachment mechanism 118, an example of which is illustrated in FIG. 3. As illustrated in FIG. 3, the attachment mechanism 118 includes two attachment arms 144 that extend from the body of the attachment mechanism 118. The attachment arms 144 that extend from the body of the attachment mechanism 118 define two gaps 146 between the attachment arms 144 and the body of the attachment mechanism 118 that are configured to receive the rail 104 of an operating table. Thus, the attachment arms 144 can be hooked over the rail 104 of an operating table such that the attachment arms 144 are located on one side of the rail 104 and the body of the attachment mechanism 118 is located on the other side of the rail 104, thereby enabling the attachment mechanism 118 to be secured to the rail 104 of the operating table.

A slot 148 also is formed through the body of the attachment mechanism 118 and configured to receive the shaft portion 142 of the L-shaped support 116. Thus, the shaft portion 142 of the L-shaped support 116 can be inserted in slot 148 when the attachment mechanism 118 is secured to the rail 104 of the operating table in order to secure the leg holder 100 to the operating table. Specifically, a number of locking holes 150 are formed through the shaft portion 142 of the L-shaped support 116 in a substantially linear pattern along the length of the shaft portion 142 of the L-shaped support. These locking holes 150 are configured to receive a spring-loaded pull pin 152 mounted on and threaded through the body of the attachment mechanism 118, thereby enabling the shaft portion 142 of the L-shaped support 116 to be locked into any of a number of different positions relative to the attachment mechanism 118 by pulling the spring-loaded pull pin 152 out of and away from the body of the attachment mechanism 118, sliding the shaft portion 142 of the L-shaped support 116 into or out of the slot 148 formed in the attachment mechanism 118 until the spring-loaded pull pin 152 is aligned with one of the locking holes 150 formed in the shaft portion 142 of the L-shaped support 116, and then releasing the spring-loaded pull pin 152 such that it engages the hole 150 formed in the shaft portion 142 of the L-shaped support 116. Among other things, the ability to adjust how much of the shaft portion 142 of the L-shaped support 116 is received within the attachment mechanism 118 in this manner enables the height of the leg holder 100, and thus the height of the patient's leg 102, to be adjusted to the height desired by the surgeon or other healthcare professional.

A number of implementations have been described. Nevertheless, it will be understood that various modifications may be made without departing from the spirit and scope of this disclosure. For example, although the adjustable arms of the leg holder generally are described above as being coupled to the leg holder by pivotable hinges in pairs of two, each of the adjustable arms may instead be connected to the leg holder by its own pivotable hinge, thereby enabling each individual adjustable arm to be adjusted independently of the other adjustable arms. Additionally or alternatively, while the leg holder generally is described above as including four adjustable arms for clamping around a patient's leg, implementations may include other numbers of adjustable arms (e.g., two, five, or six) for clamping around a patient's leg. Accordingly, other implementations are within the scope of the following claims.

What is claimed is:

1. A leg holder assembly for stabilizing a patient's leg during surgery, comprising:

a leg support apparatus including:

a planar support apparatus, a plurality of adjustable arms that extend from the planar support apparatus, that are mechanically coupled to the planar support apparatus such that the adjustable arms can be pivoted about the planar support apparatus, and that define a space between the adjustable arms that is configured to receive a patient's leg and that enables a patient's leg to be received between the adjustable arms and rested on a portion of the planar support apparatus, and a support shaft mechanically coupled to and extending substantially perpendicularly from the planar support apparatus; and a rail attachment mechanism including a body and a plurality of attachment arms that extend from the body and that define slots between the body and the attachment arms, the slots defined between the body and the attachment arms being configured to receive a rail of an operating table thereby enabling the rail attachment mechanism to be secured to the rail of an operating table by hooking the arms of the rail attachment mechanism over the rail of an operating table such that the rail is received within the slots defined between the body and the attachment arms, wherein a slot is formed within the body of the rail attachment mechanism that is configured to receive the support shaft and to enable the support shaft to be slid into and out of the slot for attachment and detachment of the leg support apparatus to the rail of the operating table.

2. The leg holder assembly of claim 1, wherein the plurality of adjustable arms include a first set of two adjustable arms located at a first lateral position along the planar support apparatus and a second set of two adjustable arms located at a second lateral position along the planar support apparatus that is displaced from the first lateral position along the planar support apparatus such that the displacement between the first set of two adjustable arms and the second set of two adjustable arms defines the space between the adjustable arms that is configured to receive a patient's leg and that enables a patient's leg to be received between the adjustable arms and rested on a portion of the planar support apparatus, the leg holder assembly further comprising:

a first pivotable hinge that mechanically couples the first set of two adjustable arms to the planar support apparatus at the first lateral position; and a second pivotable hinge that mechanically couples the second set of two adjustable arms to the planar support apparatus at the second lateral position.

3. The leg holder assembly of claim 2 wherein:

the first pivotable hinge enables the first set of two adjustable arms to clamp down around a patient's leg received within the space between the adjustable arms with a desired tightness; and the second pivotable hinge enables the second set of two adjustable arms to clamp down around a patient's leg received within the space between the adjustable arms with a desired tightness.

4. The leg holder assembly of claim 2 wherein:

the first pivotable hinge is a self-locking pivotable hinge that automatically locks the first set of two adjustable arms into a desired position when a patient's leg is received within the space between the adjustable arms; and the second pivotable hinge is a self-locking pivotable hinge that automatically locks the second set of two adjustable arms into a desired position when a patient's leg is received within the space between the adjustable arms.

5. The leg holder assembly of claim 1 wherein foam pads are disposed on each of the adjustable arms.

6. The leg holder assembly of claim 1 wherein a foam pad is disposed on the planar support apparatus between the adjustable arms that extend from the planar support apparatus.

7. The leg holder assembly of claim 1 wherein the planar support apparatus includes:

a base plate, the adjustable arms extending from and being mechanically coupled to the base plate;

a base plate extension plate that is mechanically coupled to the base plate; and a swivel plate that is mechanically coupled to the base plate extension plate by a rotatable joint and that is mechanically coupled to the support shaft.

8. The leg holder assembly of claim 7 wherein:

a groove is formed within an underside of the base plate, the groove being configured to receive the base plate extension plate;

the base plate extension plate is mechanically coupled to the base plate such that the base plate extension plate is configured to slide into and out of the groove formed within the underside of the base plate, enabling a lateral extent of the leg support apparatus to be adjusted;

a spring-loaded pull pin is mounted on the base plate; and a plurality of locking holes are formed through the base plate extension plate and configured to receive the spring-loaded pull pin such that the lateral extent of the leg support apparatus can be locked into a fixed length by threading the spring-loaded pull pin mounted on the base plate through one of the locking holes formed through the base plate extension plate.

9. The leg holder assembly of claim 7 wherein:

the rotatable joint that mechanically couples the swivel plate to the base plate extension plate enables the swivel plate to be rotated about the base plate extension plate;

a spring-loaded pull pin is mounted on the base plate extension plate; and a plurality of locking holes are formed through the swivel plate and configured to receive the spring-loaded pull pin such that the swivel plate can be locked into a fixed angle relative to the base plate extension plate by threading the spring-loaded pull pin mounted on the base plate extension plate through one of the locking holes formed through the swivel plate.

10. The leg holder assembly of claim 7 wherein:

the support shaft is an L-shaped support shaft having a support portion and a shaft portion extending substantially perpendicularly from the support portion;

the support shaft is mechanically coupled to the swivel plate by a rotatable joint that enables the swivel plate to be rotated relative to the support shaft;

a spring-loaded pull pin is mounted on the support portion of the support shaft; and a plurality of locking holes are formed through the swivel plate in a substantially circular pattern and configured to receive the spring-loaded pull pin such that the swivel plate can be locked into a fixed angle relative to the support shaft by threading the spring-loaded pull pin mounted on the support shaft through one of the locking holes formed through the swivel plate.

11. The leg holder assembly of claim 7 wherein:

the support shaft is an L-shaped support shaft having a support portion and a shaft portion extending substantially perpendicularly from the support portion;

the slot formed within the body of the rail attachment mechanism is configured to receive the shaft portion of the support shaft and to enable the support shaft to be slid into and out of the slot;

a spring-loaded pull pin is mounted on the body of the rail attachment mechanism; and a plurality of locking holes are formed along a length of the shall portion of the support shall in a substantially linear pattern and configured to receive the spring-loaded pull pin such that, when the shaft portion of the support shall is received within the slot formed within the body of the rail attachment mechanism, the shaft portion of the support shaft can be locked at a fixed position relative to the rail attachment mechanism by threading the spring-loaded pull pin mounted on the body of the rail attachment mechanism through one of the locking holes formed through the shaft portion of the support shaft.

* * * * *

UNITED STATES PATENT AND TRADEMARK OFFICE

CERTIFICATE OF CORRECTION

PATENT NO. : 8,099,808 B1
APPLICATION NO. : 12/715013
DATED : January 24, 2012
INVENTOR(S) : Brian P. McKeon It is certified that error appears in the above-identified patent and that said Letters Patent is hereby corrected as shown below:

Column 9, claim 11 (line 12 of claim 11), delete "shall" (first and second occurrences) and insert -- shaft --, therefor.

Column 10, claim 11 (line 2 of claim 11), delete "shall" and insert -- shaft --, therefor.

Signed and Sealed this
Tenth Day of April, 2012

David J. Kappos

David J. Kappos
*Director of the United States Patent and Trademark Office*